US008549686B2

(12) United States Patent
Wang et al.

(10) Patent No.: US 8,549,686 B2
(45) Date of Patent: Oct. 8, 2013

(54) ADJUSTABLE BED

(75) Inventors: Cheng-Chung Wang, Taipei (TW); Chien-Hua Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 70 days.

(21) Appl. No.: 13/092,008

(22) Filed: Apr. 21, 2011

(65) Prior Publication Data

US 2011/0265267 A1 Nov. 3, 2011

(30) Foreign Application Priority Data

Apr. 23, 2010 (CN) ..... 2010 1 0160570

(51) Int. Cl.
*A47C 17/00* (2006.01)

(52) U.S. Cl.
USPC ..... 5/722; 5/706; 5/710; 5/615

(58) Field of Classification Search
USPC ..... 5/722, 615, 710, 706; 297/452.1, DIG. 8
See application file for complete search history.

(56) References Cited

U.S. PATENT DOCUMENTS

2005/0114998 A1* 6/2005 Leventhal et al. ..... 5/615
2011/0107520 A1* 5/2011 Neggers ..... 5/706

* cited by examiner

*Primary Examiner* — Peter M Cuomo
*Assistant Examiner* — Brittany Wilson

(57) ABSTRACT

An inflatable bed having a primary body, a backrest selectively inclinable relative to the primary body, a slit defined at a junction of the primary body and the backrest, and a pouch received in the slit to be selectively inflatable to move the backrest relative to the primary body. The slit is defined in a manner that when the pouch is inflated and the backrest is lifted by the pouch, friction of a bottom face of the backrest to a top face of ground where the inflatable bed is rested is minimized so as to facilitate the inclinable movement of the backrest relative to the primary body.

20 Claims, 6 Drawing Sheets

ADJUSTABLE BED

BACKGROUND OF THE INVENTION

1. Field of the Invention

The present invention generally relates to an inflatable bed, and more particularly to an adjustable inflatable bed having a backrest, a primary body integrally formed with the backrest, a slit defined between a joint between the backrest and the primary body and an inflatable pouch received in the slit to provide support to the backrest when being inflated.

2. Description of the Prior Art

Inflatable beds have been extensively used in all kinds of purposes for its convenience, compactness and ergonomic features. When the bed is fully inflated and a user is lying thereon, the top surface of the bed provides even support to the user because the top periphery matches every part of the user and can therefore provide a comfortable environment for the user. Furthermore, for senior citizens, disables or sick people who are incapable of turning while lying on the bed, this kind of bed will not cause symptoms out of bad blood circulation. In addition to the advantages set forth, situations such as a temporary bed is required for campers, travelers, bag packers, unexpected guests at home . . . etc., this compact and convenient bed provides fast setting and comfortable relaxation to all requesters.

In order to cope with different requirements from users, nowadays, the inflatable bed is somehow equipped with a foldable backrest which is still connected to the primary body on which the lower half of a user lies. The foldable backrest is adaptive to the users' requests so that when the user is reading something, the user can now lean on the backrest tilted relative to the primary body of the bed. The principle of this foldable backrest is that there is an additional air pouch provided between the backrest and the primary body. Therefore, depending on the hardness of the additional air pouch, the user can randomly adjust the angle of the backrest relative to the primary body of the bed to provide comfort whenever required. Check valves are provided to communicate the backrest with the primary body as well as the additional air pouch and the check valves are implemented in such a way that when the air pouch is inflated, the backrest and the primary body are also inflated and when a user is lying on top of the primary body, the air will not flow backward and escape from the bed. Though as convenient and comfortable as it may be, there is a major drawback to this foldable backrest design. Because the additional air pouch is sandwiched between the backrest and the primary body, it is impossible to flush the backrest to the primary body even with the air pouch fully deflated.

SUMMARY OF THE INVENTION

To address these and other objectives and in view of its purposes, the present invention provides an inflatable bed consisted of a backrest, a primary body integrally formed with the backrest, a slit defined between the backrest and the primary body to partially divide the backrest and the primary body and an air pouch inflatably received in the slit to selectively support a user and tilt the backrest relative to the primary body to further provide comfort to the user thereon.

In accordance with another objective of the present invention, the inflatable bed constructed in accordance with the present invention has a first angle formed between a sidewall of the slit and a bottom face of the backrest and a second angle formed between a sidewall of the slit and a bottom face of the primary body, wherein the first angle and the second angle are so defined that raise of the backrest is readily accomplished.

In accordance with still another objective of the present invention, the first angle and the second angle of the inflatable bed constructed in accordance with the present invention are complementary to one another.

In accordance with a further objective of the present invention, the inflatable bed constructed in accordance with the present invention has a top side, a bottom side, a skirt integrally connecting the top side to the bottom side and baffles formed between the top side and the bottom side to sustain shape of and to form compartments in the inflatable bed.

Still another objective of the present invention is that the inflatable bed has a top side, a bottom side, a skirt integrally connecting the top side to the bottom side so as to form a space and baffles formed between the top side and the bottom side and in the space to sustain shape of and to form compartments in the inflatable bed.

A further objective of the present invention is that there are at least two skirts to close two openings defined after the top side and the bottom side are connected together.

Still a further objective of the present invention is that there is an inflatable air pouch received in the slit to selectively provide support to the backrest.

DETAILED DESCRIPTION OF THE PREFERRED EMBODIMENT

Figure 1:
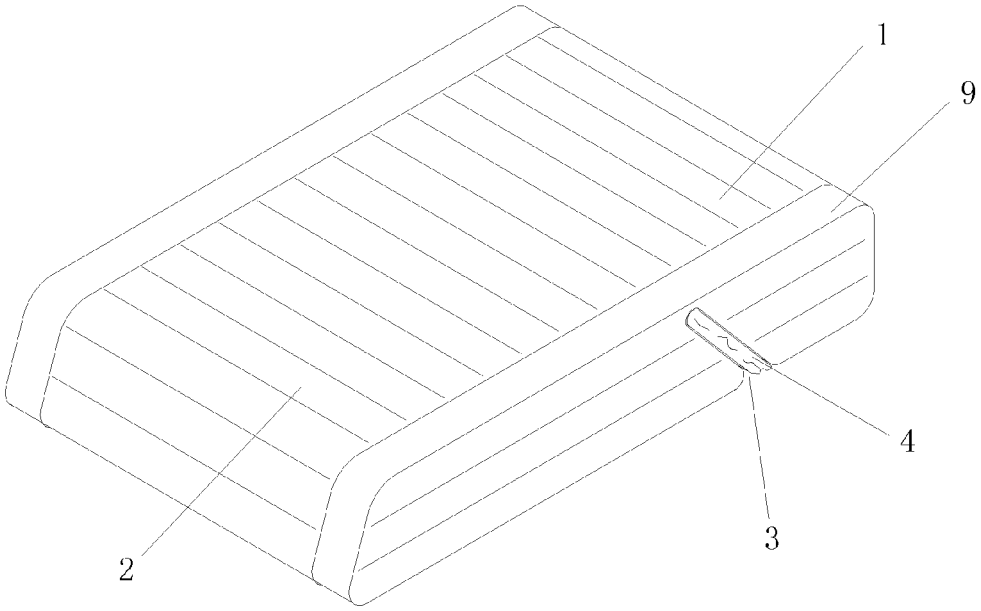
FIG. 1 is a perspective view of the inflatable bed of a preferred embodiment of the present invention.
Figure 2:
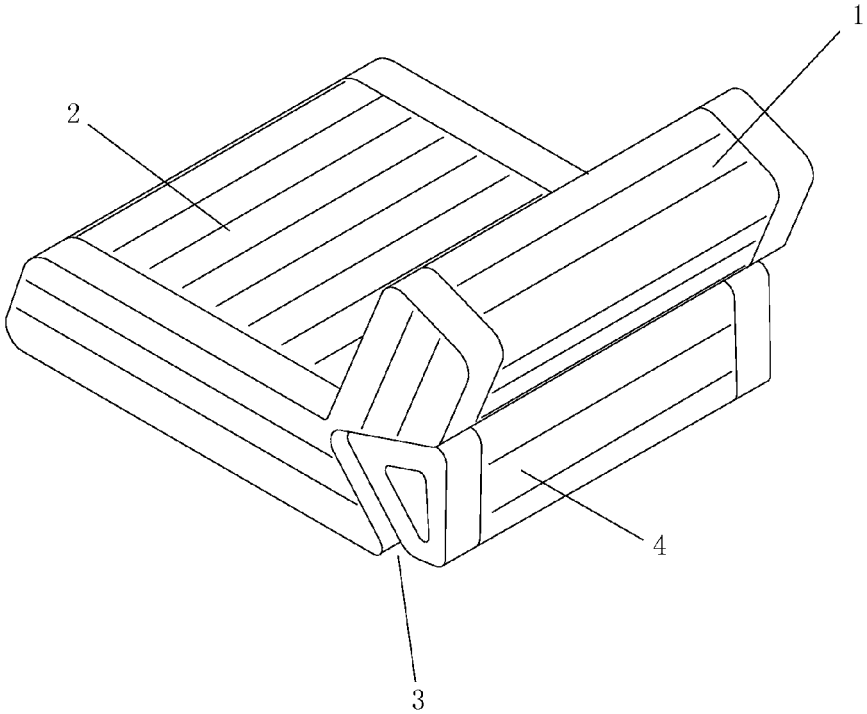
FIG. 2 is a perspective view of the inflatable bed with the backrest raised relative to the primary body of the inflatable bed.

With reference to FIGS. 1 and 2, a preferred embodiment of the inflatable bed of the present invention is shown and has a backrest 1, a primary body 2 partially and integrally connected to a portion of the backrest 1, a slit 3 defined between the backrest 1 and the primary body 2 and a pouch 4 inflatably received in the slit 3. With the provision of the slit 3 and the pouch 4 inside the slit 3, the backrest 1 is able to be lifted to an angle relative to the primary body 2.

Figure 3:
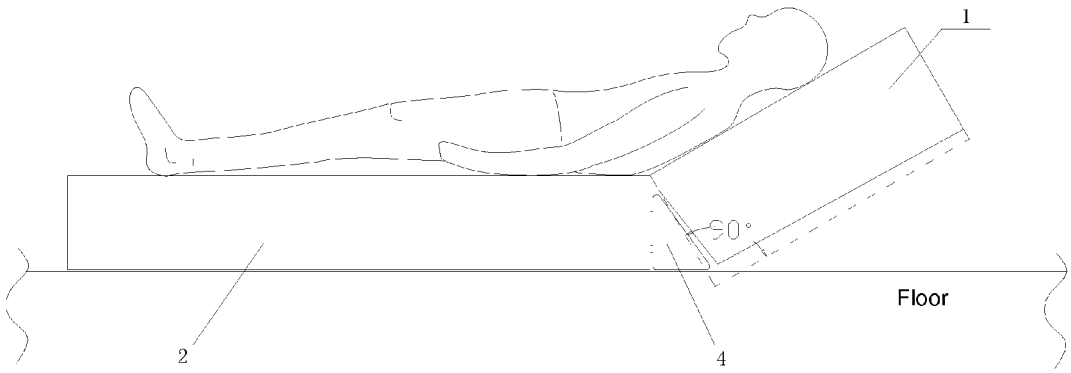
FIG. 3 is a schematic view showing the drawback of a design relative to the features of the preferred embodiment of the present invention.
Figure 4:
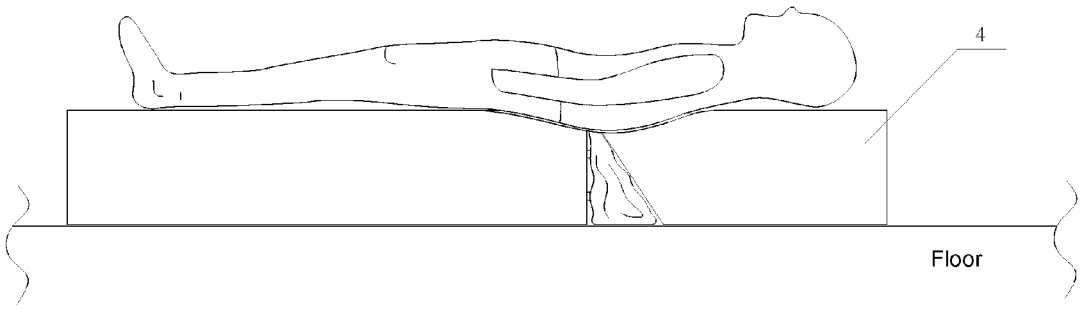
FIG. 4 is a schematic view showing the drawback of a design relative to the features of the preferred embodiment of the present invention.
Figure 5:
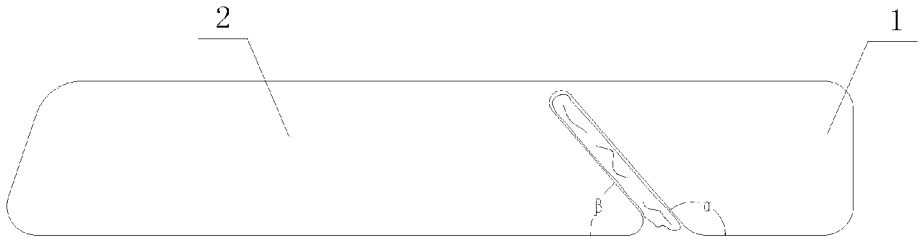
FIG. 5 is a schematic view showing the preferred embodiment of the present invention, wherein the slit is so defined in the joint between the backrest and the primary body to facilitate the raising movement of the backrest relative to the primary body.

With reference to FIGS. 3, 4 and 5, it is to be noted that the slit 3 is composed of a first angle and a second angle and defined between the backrest 1 and the primary body 2 in such a way that a first angle ($\alpha$) is defined between a bottom face of the backrest 1 and a side face of the slit 3 and a second angle ($\beta$) is defined between a side face of the slit 3 and a bottom face of the primary body 2. Although the accompanied drawings show a particular structure of the angles, it is noted that even though the side face of the slit 3 is made undulated or has other designed features for easy manufacture considerations thereon, the intersection of the extension of the side face of the slit 3 and the bottom face of the backrest 1 defines the first angle. Furthermore, due to the design of the first angle and the second angle, the backrest 1 is generally a trapezoid with an upper side face longer than a bottom face thereof. From the applications of the inflatable bed constructed in accordance with the present invention, it is noted that if the first angle ($\alpha$) is 90 degrees or less, the resistance between the bottom face of the backrest 1 and the ground face where the inflatable bed is rested will hinder the upward movement of the backrest 1 relative to the primary body 2 while the pouch 4 is being inflated. That is, if the first angle is 90 degrees or less and when the pouch 4 is being inflated, the friction between the bottom face of the backrest 1 and the ground continues slowing down the upward movement of the backrest 1 relative to the ground, which also weakens the thickness of the bottom face of the backrest 1. In addition, if the second angle ($\beta$) is at 90 degrees or larger, there will be no sufficient support to the hip portion of a user lying on the top surface of the inflatable bed of the present invention. It is because when the second angle is at 90 degrees or larger, there will be a "dent" at the distal intersection between the first angle and the second angle. And that is generally fit to the user's hip portion. As obviously as one can imagine, when there is a dent, the support to anything on top of the dent should be less than other places where there is no such structure. After continuous experiments and trials, it is noted that the slit 3 is defined that the first angle ($\alpha$) is larger than 90 degrees and the second angle ($\beta$) is less than 90 degrees. Preferably, the first angle is complementary to the second angle. Further notice is directed to the fact that the slit 3 is a blind hole and the bottom of the blind hole is defined to tilt toward the primary body 2.

Figure 6:
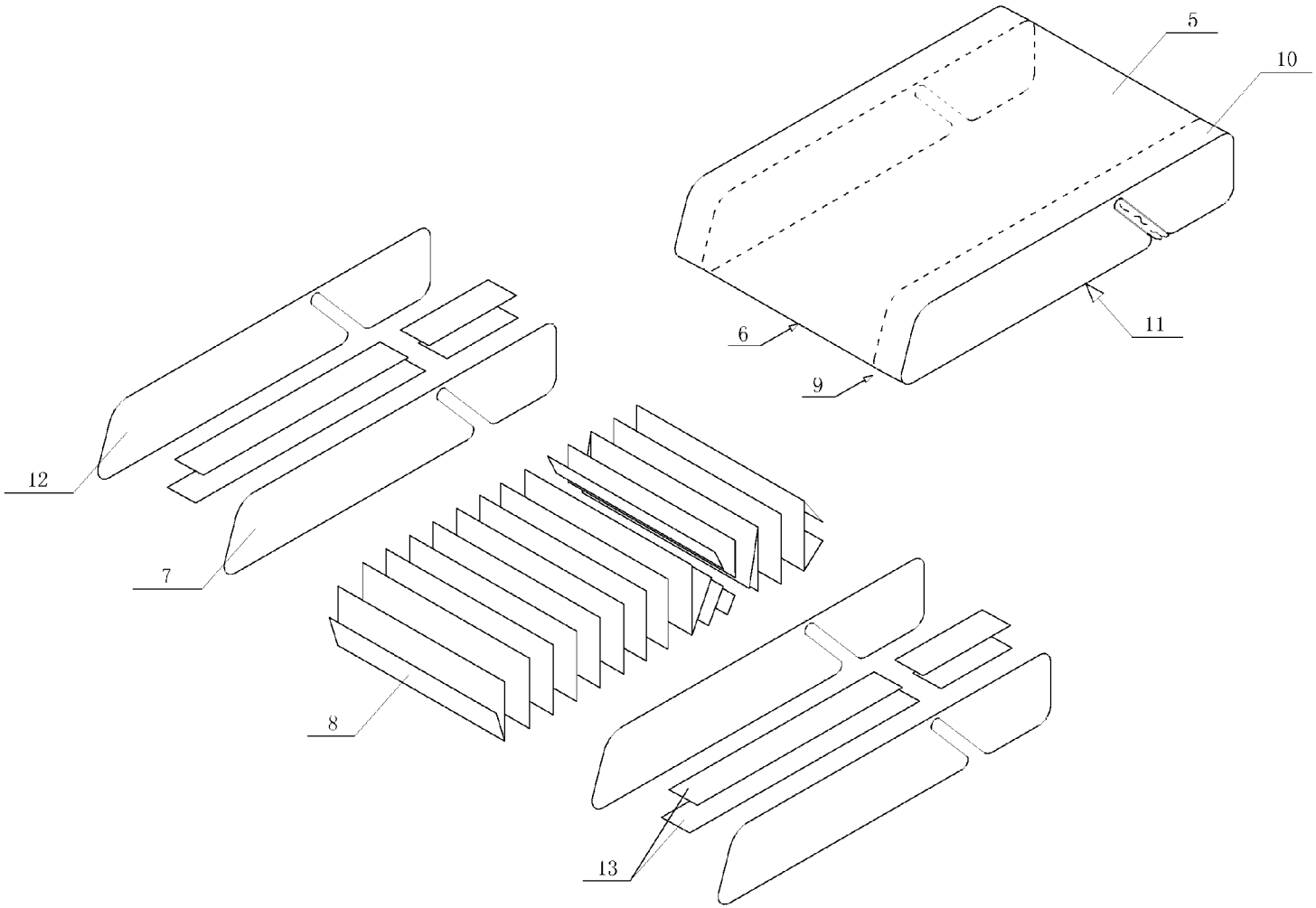
FIG. 6 is an exploded perspective view showing one example of an embodiment of the internal structure of the inflatable bed of the present invention.

With reference to FIG. 6, a preferred embodiment of the present invention is shown to have a top 5, a bottom 6 and a skirt 7 respectively connecting a peripheral edge of the top 5 to a peripheral edge of the bottom 6 to form an air-tight enclosure. In this embodiment, the skirt 7 is divided into a first skirt implemented to one side of the inflatable bed and a second skirt implemented to the other side of the inflatable bed. Each of the first and the second skirt is provided with a slit defined in the way as described earlier. Further, to maintain the distance between the top 5 and the bottom 6, an undulated baffle 8 is respectively and securely connected to an undersurface of the top 5 and a top surface of the bottom 6 such that after the user is lying on the top surface of the top 5, deformation of the inflatable bed is limited to a degree. In order to adapt to the sectional design of the backrest 1 and the primary body 2, the skirt 7 as well as the undulated baffle 8 is also sectioned. To further enhance the deformation limitation design of the inflatable bed of the present invention, a first elongated auxiliary pouch (not numbered) is provided to the first skirt and a second elongated auxiliary pouch (not numbered) is provided to the second skirt. Here the word "elongated" intends only to show one preferred embodiment of the invention and does not intend in any way to try to limit the shape of the auxiliary pouch. That is, the auxiliary pouch can be any shape suitable for the first skirt and the second skirt. Both the first and the second elongated auxiliary pouch (the elongated pouch 9) are respectively and securely connected to the top 5 and the bottom so that when the inflatable bed of the present invention is inflated, sideward deformation of the bed is limited by the elongated pouch 9. Each of the first and second elongated pouch consists of a top 10, a bottom 11 and a side skirt 12 securely connected to a peripheral edge of the top 10 and a peripheral edge of the bottom 11 as well as a side face of the first/second skirt to form an air-tight pouch. Limiting straps 13 are provided between a side face of the first elongated pouch and a side face of the first skirt and a side face of the second elongated pouch and a side face of the second skirt to restrain the inflatable bed of the present invention from further deformation.

Figure 7:
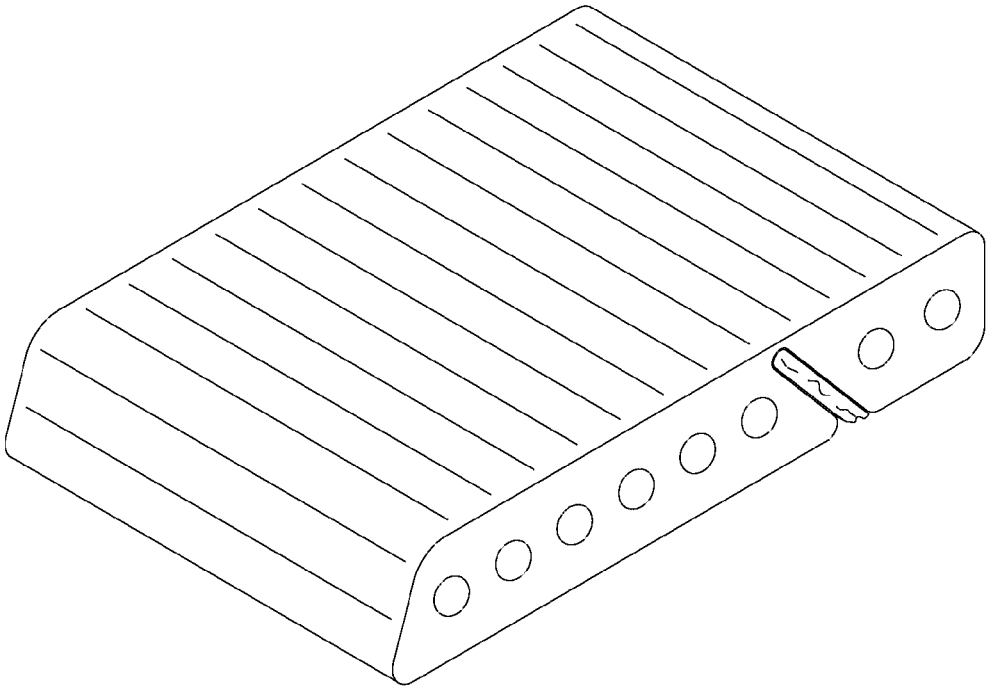
FIG. 7 is a perspective view of another preferred embodiment of the inflatable bed of the present invention.
Figure 8:
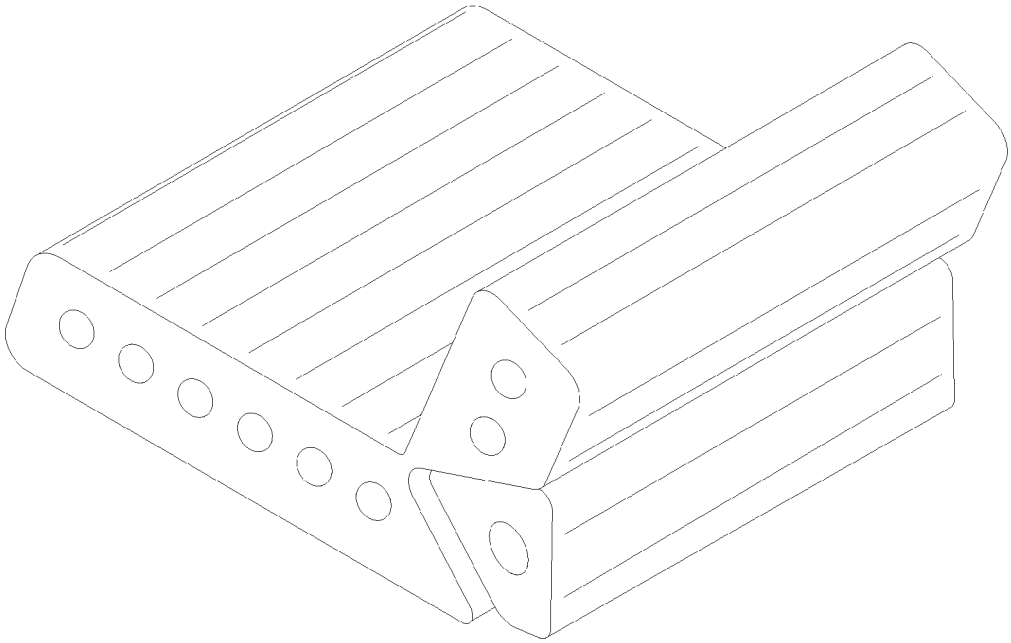
FIG. 8 is a perspective view of the preferred embodiment of the inflatable bed of FIG. 7 with the backrest raised relative to the primary body.
Figure 9:
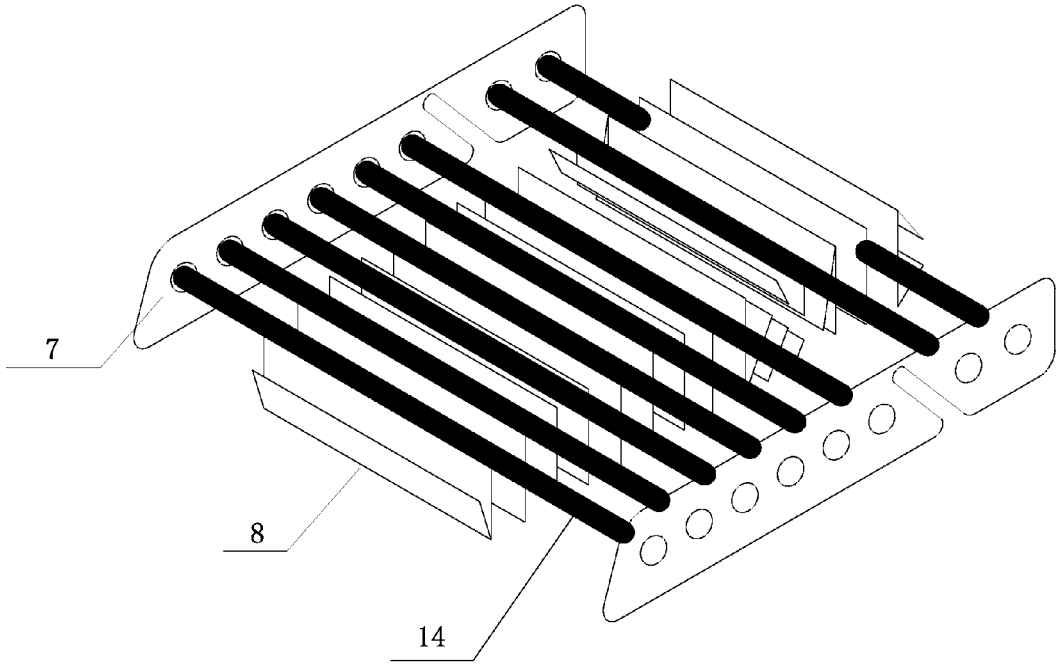
FIG. 9 is a perspective view showing still another preferred embodiment of the inflatable bed of the present invention, wherein the top face and the bottom face of the inflatable bed are removed for clarity

With reference to FIGS. 7, 8 and 9, another preferred embodiment of the present invention is shown. Instead of the auxiliary pouch 9 to limit the deformation of the inflatable bed of the present invention, restraining straps 14 directly extending between the top 5 and the bottom 6 are provided to securely connected to the first skirt and the second skirt such that when the user is lying on the top surface of the top 5, the sideward movement (deformation) of the inflatable bed is limited.

Figure 10:
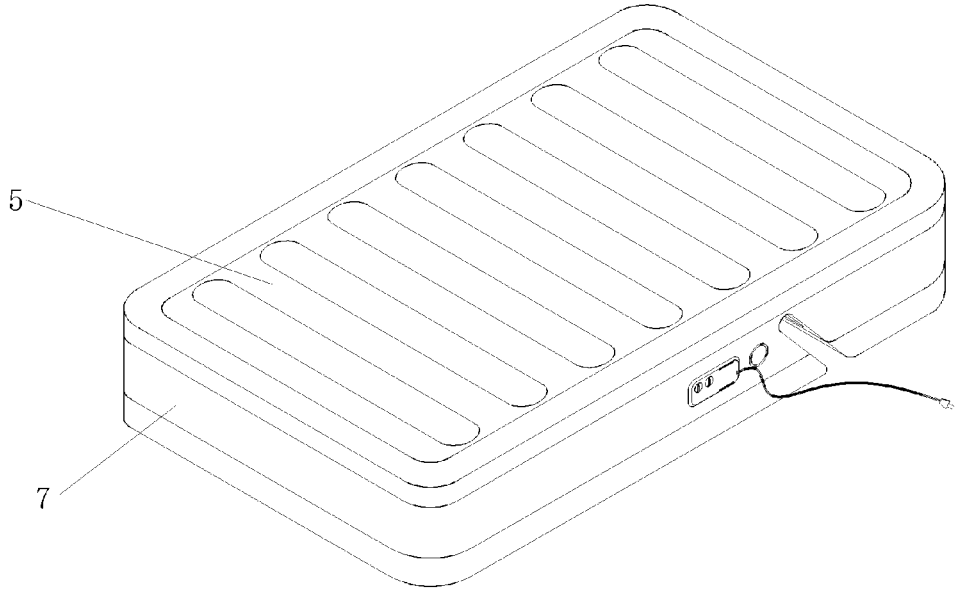
FIG. 10 is a perspective view showing a further embodiment of the inflatable bed of the present invention.
Figure 11:
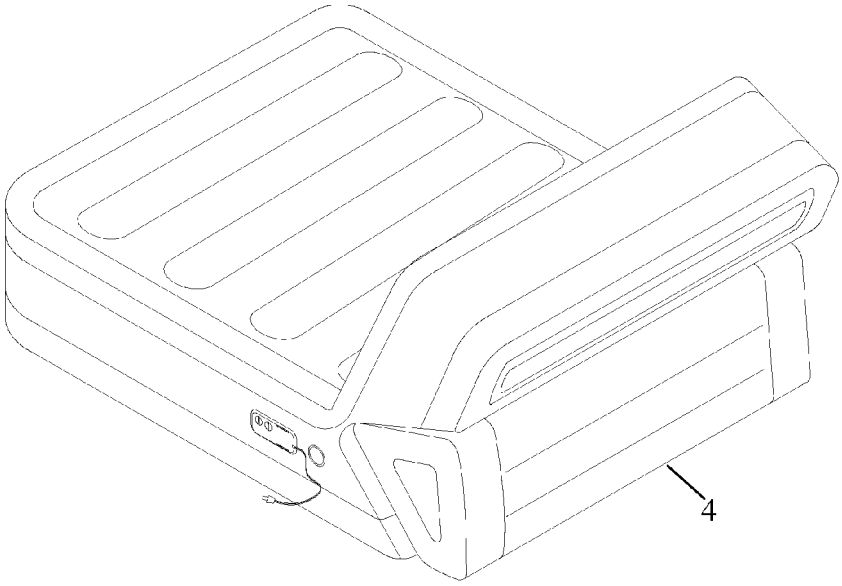
FIG. 11 is a perspective view showing an embodiment of the inflatable bed of FIG. 10 with the backrest raised relative to the primary body.
Figure 12:
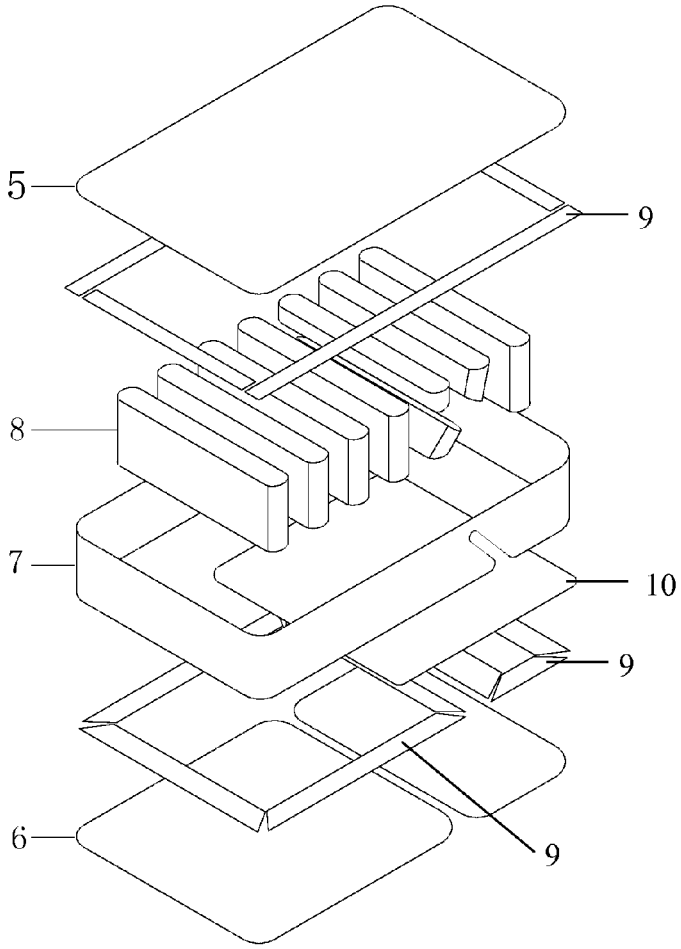
FIG. 12 is an exploded perspective view showing elements of the preferred embodiment of FIG. 10 of the present invention.

With reference to FIGS. 10, 11 and 12, wherein another preferred embodiment of the present invention is shown. It is to be noted that the bottom 6 is now divided into two portions, one being larger than the other. One portion of the bottom 6 is adapted to fit to the backrest 1 and the other portion of the bottom 6 is adapted to fit to the primary body 2. In addition to the sectioned bottom 6, this embodiment of the present invention further has a mat 10 employed to cover the junction of the two portions of the bottom 6. As a result of the addition of the mat 10, a portion of the undulated baffles 8 is securely connecting the top 5 to the bottom 6, a portion of the undulated baffles 8 is securely connecting the top 5 to the mat and a portion of the undulated baffles 8 is securely connecting the mat 10 to the bottom 6. Under the arrangement, the inflatable bed of the present invention is able to maintain its shape in a load free situation and limit its deformation when there is a load on the top face of the top 5. A further note is that the skirt 7 is annular in shape to be adapted to the top 5 and the bottom 6. Another limiting straps 9 are provided at corners of the inflatable bed of the present invention to help shape the bed. The connection of the limiting straps 9 to either the top 5 or the bottom 6 is either by supersonic welding or gluing. The limiting straps 9 are provided inside the inflatable bed of the present invention such that they will not hinder the movement of the bed in any way. As shown in the drawings so provided, it is noted that the pouch 4 is trapezoidal in shape, wherein the longer side of the trapezoid is in contact with the bottom face of the backrest and the shorter side of the trapezoid is in contact with the bottom face of the primary body.

What is claimed is:

1. An inflatable bed comprising:

a primary body having a bottom face;

a backrest having a bottom face, wherein the backrest is selectively inclinable relative to the primary body;

a slit defined at a junction of the primary body and the backrest; and a pouch received in the slit to be selectively inflatable to move the backrest relative to the primary body, wherein the slit extends from the bottom faces of the primary body and the backrest, and wherein the bottom faces of the primary body and the backrest are co-planar when the primary body and the backrest are inflated and the pouch is deflated.

2. The inflatable bed as claimed in claim 1, wherein the slit is defined to have a first angle defined between the bottom face of the backrest and a first side face of the slit corresponding to the backrest and a second angle defined between the bottom face of the primary body and a second side face of the slit corresponding to the primary body, wherein the first angle is larger than 90 degrees and the second angle is less than 90 degrees.

3. The inflatable bed as claimed in claim 2, wherein the second angle is complementary to the first angle.

4. The inflatable bed as claimed in claim 3, wherein each of the backrest and the primary body has a top, a bottom and a skirt respectively connecting a peripheral edge of the top to a peripheral edge of the bottom to form an air-tight enclosure.

5. The inflatable bed as claimed in claim 1 further comprising undulated baffles respectively and securely connected to an undersurface of the top and a top surface of the bottom such that deformation of the inflatable bed is limited.

6. The inflatable bed as claimed in claim 1, wherein each of the backrest and the primary body has a top, a bottom and a skirt respectively connecting a peripheral edge of the top to a peripheral edge of the bottom to form an air-tight enclosure, the skirt is divided into a first skirt implemented to one side of the inflatable bed and a second skirt implemented to the other side of the inflatable bed, each of the first skirt and the second skirt is provided with an opening adapted to fit to the slit.

7. The inflatable bed as claimed in claim 6 further comprising auxiliary pouches respectively provided to the first skirt and the second skirt to enhance deformation limitation of the inflatable bed.

8. The inflatable bed as claimed in claim 7, wherein the bottom is divided into two halves one being adapted to fit to the backrest and one being adapted to fit to the primary body and a mat is provided to cover a junction of the two halves of the bottom, a portion of undulated baffles are provided to connect the top to the bottom, a portion of undulated baffles are provided to securely connect the top to the mat and a portion of undulated baffles are provided to securely connect the mat to the bottom respectively.

9. The inflatable bed as claimed in claim 8 further comprising limiting straps provided between side faces of the auxiliary pouches and side faces of the first skirts and the other side faces of the auxiliary pouches and the other side faces of the second skirts to restrain the inflatable bed from further deformation.

10. The inflatable bed as claimed in claim 7 further comprising limiting straps provided between side faces of the auxiliary pouches and side faces of the first skirts and the other side faces of the auxiliary pouches and the other side faces of the second skirts to restrain the inflatable bed from further deformation.

11. The inflatable bed as claimed in claim 1, wherein each of the backrest and the primary body has a top, a bottom and a skirt respectively connecting a peripheral edge of the top to a peripheral edge of the bottom to form an air-tight enclosure, the skirt is divided into a first skirt implemented to one side of the inflatable bed and a second skirt implemented to the other side of the inflatable bed, each of the first skirt and the second skirt is provided with an opening adapted to fit to the slit, wherein restraining straps are provided to respectively and securely connect the first skirt to the second skirt so as to enhance deformation limitation of the inflatable bed.

12. The inflatable bed as claimed in claim 11, wherein the bottom is divided into two halves one being adapted to fit to the backrest and one being adapted to fit to the primary body and a mat is provided to cover a junction of the two halves of the bottom, a portion of undulated baffles are provided to connect the top to the bottom, a portion of undulated baffles are provided to securely connect the top to the mat and a portion of undulated baffles are provided to securely connect the mat to the bottom respectively.

13. The inflatable bed as claimed in claim 12 further comprising limiting straps provided between side faces of the auxiliary pouches and side faces of the first skirts and the other side faces of the auxiliary pouches and the other side faces of the second skirts to restrain the inflatable bed from further deformation.

14. The inflatable bed as claimed in claim 1, wherein a first angle is defined between the bottom face of the backrest and a portion of a first side face of the slit corresponding to the backrest and intersecting with the bottom face of the backrest, and a second angle is defined between the bottom face of the primary body and a portion of a second side face of the slit corresponding to the primary body and intersecting with the bottom face of the primary body, wherein the first angle is larger than 90 degrees and the second angle is less than 90 degrees.

15. The inflatable bed as claimed in claim 14, wherein the second angle is complementary to the first angle.

16. The inflatable bed as claimed in claim 1, wherein the slit is defined in a manner that when the pouch is inflated and the backrest is lifted by the pouch, friction of the bottom face of the backrest to a top face of ground where the inflatable bed is rested is minimized so as to facilitate the inclinable movement of the backrest relative to the primary body.

17. An inflatable bed comprising:

a primary body;

a backrest selectively inclinable relative to the primary body;

a slit defined at a junction of the primary body and the backrest; and a pouch received in the slit to be selectively inflatable to move the backrest relative to the primary body, wherein the slit is defined in a manner that when the pouch is inflated and the backrest is lifted by the pouch, friction of a bottom face of the backrest to a top face of ground where the inflatable bed is rested is minimized so as to facilitate the inclinable movement of the backrest relative to the primary body, wherein each of the backrest and the primary body has a top, a bottom and a skirt respectively connecting a peripheral edge of the top to a peripheral edge of the bottom to form an air-tight enclosure.

18. The inflatable bed as claimed in claim 17, wherein the bottom is divided into two halves one being adapted to fit to the backrest and one being adapted to fit to the primary body and a mat is provided to cover a junction of the two halves of the bottom, a portion of undulated baffles are provided to connect the top to the bottom, a portion of undulated baffles are provided to securely connect the top to the mat and a portion of undulated baffles are provided to securely connect the mat to the bottom respectively.

19. An inflatable bed comprising:

a primary body;

a backrest selectively inclinable relative to the primary body;

a slit defined at a junction of the primary body and the backrest; and a pouch received in the slit to be selectively inflatable to move the backrest relative to the primary body, wherein the slit is defined in a manner that when the pouch is inflated and the backrest is lifted by the pouch, friction of a bottom face of the backrest to a top face of ground where the inflatable bed is rested is minimized so as to facilitate the inclinable movement of the backrest relative to the primary body, wherein the pouch is connected to at least the primary body or the backrest.

20. The inflatable bed as claimed in claim 19, wherein each of the backrest and the primary body has a top, a bottom and a skirt respectively connecting a peripheral edge of the top to a peripheral edge of the bottom to form an air-tight enclosure.

* * * * *